United States Patent [19]

Kobayashi et al.

[11] Patent Number: 4,642,528

[45] Date of Patent: Feb. 10, 1987

[54] PICTURE CORRECTING APPARATUS FOR USE WITH IN-LINE TYPE COLOR PICTURE TUBE

[75] Inventors: Toshio Kobayashi, Noda; Hideo Hishiki, Iwai, both of Japan

[73] Assignee: Victor Company of Japan, Ltd., Yokohama, Japan

[21] Appl. No.: 680,680

[22] Filed: Dec. 12, 1984

[30] Foreign Application Priority Data

Dec. 12, 1983 [JP] Japan ..... 58-234024

[51] Int. Cl.[4] ..... H01J 29/70; H01J 29/76

[52] U.S. Cl. ..... 315/368; 315/400; 335/210

[58] Field of Search ..... 335/210, 212, 213; 336/110, 160; 315/368, 400, 371

[56] References Cited

U.S. PATENT DOCUMENTS 4,445,101 4/1984 Kobayashi et al. ..... 335/210
4,554,488 11/1985 Kobayashi et al. ..... 315/400
4,588,930 5/1986 Kobayashi et al. ..... 315/400

FOREIGN PATENT DOCUMENTS 3222280 2/1983 Fed. Rep. of Germany .

OTHER PUBLICATIONS

Patents Abstracts of Japan, vol. 8, No. 231 (E-274) [1668], Oct. 24, 1984; & JP-A-59 111 491 (Nippon Victor) 27-06-1984.

*Primary Examiner*—Theodore M. Blum
*Assistant Examiner*—Gregory C. Issing
*Attorney, Agent, or Firm*—Pollock, VandeSande & Priddy

[57] ABSTRACT

In a deflection yoke of self-convergence system for use with in-line type color picture tube, the intensity of a magnetic field, which causes the change in impedance of coils of saturable reactors respectively connected in series with two horizontal deflecting coils, is increased so that the variation rate of the inductance expressed in terms of a differential coefficient has the relationship of $\theta e/\theta m \leqq 0.5$ wherein $\theta m$ is a differential coefficient around the center of the picture where the degree of vertical deflection is very small and $\theta e$ is a differential coefficient at top and bottom sides of the picture where the degree of vertical deflection is maximum. In one embodiment, an auxiliary coil connected to the vertical deflection coils is employed in each of the saturable reactors so as to increase the intensity of the magnetic field applied to the saturable reactors. In another embodiment, metallic member(s) is/are arranged to be close to the saturable reactors so as to reduce reluctance.

7 Claims, 32 Drawing Figures

PICTURE CORRECTING APPARATUS FOR USE WITH IN-LINE TYPE COLOR PICTURE TUBE

BACKGROUND OF THE INVENTION

This invention relates generally to picture correcting apparatus for in-line type color picture tubes, and particularly to such apparatus using saturable reactors respectively connected in series with two horizontal deflecting coils.

Generally speaking, in color picture tubes used in color televisions, it is necessary not only to focus, at phosphor screen, the electron beams respectively emitted from three electron gun but also to converge the same. Therefore, in order to achieve satisfactory convergence of the three electron beams at the phosphor screen in conventional three-electron gun in-line type picture tubes, the horizontal deflecting magnetic field of the deflection yoke is made to have an intense pincushion shape, while the vertical deflecting magnetic field is made to have an intense barrel shape.

However, when the deflecting angle in a color picture tube becomes large such as 90 degrees or so, then pincushion distortion or barrel distortion occurs at the top and bottom of the raster when the deflecting magnetic field is arranged so as to obtain satisfactory convergence. As a result, such picture tubes are not practical. On the other hand, when the distortion at the top and bottom of the raster is satisfactorily adjusted, then positive-crossing misconvergence shown in FIG. 1 or negative-crossing misconvergence shown in FIG. 2 occurs and therefore the picture tube is not practical. In this way, in conventional color picture tubes, it has been difficult if not impossible to simultaneously satisfy convergence characteristic and top and bottom raster distortion.

The present applicant has already filed Japanese patent applications 56-91275 titled "PICTURE CORRECTING APPARATUS FOR IN-LINE COLOR PICTURE TUBE" and 56-111650 tiled "DEFLECTNG APPARATUS FOR COLOR PICTURE TUBE" as apparatus which resolve the above-mentioned problems, and corresponding patent applications in the U.S. Ser. No. 387,434 June 11, 1982, in the United Kingdom No. 8217,160 June 14, 1982, in West Germany No. P32 22 280.7 June 14, 1982, in France No. 8210,333 June 14, 1982, in Canada No. 405,016 June 11, 1982, in the Netherlands No. 8202,376 June 11.

According to this apparatus, as shown in FIGS. 5 and 6, reactors SR1*a*, SR2*a* or SR1*b*, SR2*b*, whose impedance varies at a vertical deflection period, are connected to respective horizontal deflecting coils $L_{H1}$, $L_{H2}$ among saddle shaped horizontal deflecting coils $L_{H1}$, $L_{H2}$ and a toroidal vertical deflecting coil which constitute a deflection yoke. The impedance of each of two circuits each including the horizontal deflecting coil LH1 or LH2 is varied such that impedance of one circuit increases or decreases when the impedance of the other circuit decreases or increases so as to vary the distribution of the horizontal deflecting magnetic field as a function of time, thereby obtaining satisfactory picture with convergence characteristics being corrected.

The reactors SR1*a*, SR2*a* in the apparatus of FIG. 5 have structure shown in FIG. 7. In this diagram, the references 1 and 2 are drum or spool type cores made of ferrite magnetic body, and the reference 3 is a permanent magnet which gives d.c. bias magnetic field to respective cores. On each of the spool type cores are wound coils RCH1, RCH2 connected to the horizontal deflecting coil and coils RCV1, RCV2 connected to the vertical deflecting coil. The coils are connected so that winding directions of the coils RCH1 and RCH2 are opposite to each other, while the winding directions of the coils RCV1 and RCV2 are the same.

The coils RCH1, RCH2, RCV1, RCV2 are connected to respective horizontal deflecting coils $L_{H1}$, $L_{H2}$ and to the vertical deflecting coil $L_V$ with a polarity shown in FIG. 5.

The deflecting apparatus of FIG. 6 has actual structure as seen FIGS. 8 and 9 where the deflecting apparatus is generally designated at the reference 19. The deflecting apparatus 19 is arranged such that reactors SR1*b*, SR2*b*, formed of a combination of coils wound around spool type cores, are attached to the vertical deflecting coil. Describing the apparatus further in detail, cores 4, 4' around which the vertical deflecting coil $L_V$ is wound are built in to be placed on a separator 6 made of a synthetic resin in which the horizontal deflecting coils $L_{H1}$ and $L_{H2}$ are built, and are arranged to face each other at a separating surface to be fixed by way of a clamp 7. A coil assembly $\mathbf{18}_1$ formed of two coils $\mathbf{9}_{11}$ and $\mathbf{9}_{12}$ is built in a casing 15 provided on a terminal board 14. The terminal board 14 is secured to a cylindrical flange portion 8 of the separator 14 arranged to receive a rear bend-up portion of the horizontal deflecting coils $L_{H1}$ and $L_{H2}$, and the coil assembly $\mathbf{18}_1$ is positioned on the surface of cores around the one facing portion 5 among two thereof of the cores 4, 4'. The coil assembly $\mathbf{18}_1$ constitutes a saturable reactor SR1b because it is influenced by vertical deflecting magnetic field Hv' emitted outside the cores. Another coil assembly $\mathbf{18}_2$, which forms a pair together with the coil assembly $\mathbf{18}_1$, is positioned on the surface of cores close to the other facing portion 5', and constitutes a saturable reactor SR2*b* because it is influenced by vertical deflecting magnetic field Hv" emitted outside the cores.

As seen in FIGS. 8 and 9, the coils $\mathbf{9}_{11}$, $\mathbf{9}_{12}$ formed by winding a conductive wire around spool type cores $\mathbf{10}_{11}$, $\mathbf{10}_{12}$, and a permanent magnet $\mathbf{13}_1$ which gives d.c. magnetic bias to respective cores in common, are all built in the casing 15 with a positional relationship as seen in these diagrams. The other coil assembly $\mathbf{18}_2$ has the same structure as that of the coil assembly $\mathbf{18}_1$, and comprises spool type cores $\mathbf{10}_{21}$, $\mathbf{10}_{22}$ with coils $\mathbf{11}_{21}$, $\mathbf{11}_{22}$ and a permanent magnet $\mathbf{13}_2$ for giving d.c. magnetic bias which are all built in a casing 15.

As seen in FIG. 10, the above-mentioned coils $\mathbf{11}_{11}$, $\mathbf{11}_{12}$ are connected to each other so that they are in the same direction and opposite direction respectively with respect to the vertical deflecting magnetic field Hv', while coils $\mathbf{11}_{21}$, $\mathbf{11}_{22}$ are connected to each other so that they are in the same direction and opposite direction respectively with respect to the vertical deflecting magnetic field Hv", and as seen in FIG. 6, these coils are connected to corresponding horizontal deflecting coils $L_{H1}$ and $L_{H2}$. The permanent magnets $\mathbf{13}_1$ and $\mathbf{13}_2$ respectively have radial U-shaped grooves and are attached so as to be rotated when forcibly rotated, thereby the amount of magnetic bias being changed by rotation of the same.

However, even in the above-described apparatus, misconvergence occurs such that positive crossing occurs at the center of the picture and negative crossing occurs at the periphery as shown in FIG. 3, or in a small picture tube of 12-inch or smaller type of 90° deflection, an inversed S-shaped misconvergence occurs as shown in FIG. 4 because the amount of misconvergence is large as shown in FIG. 1. It has been extremely difficult to correct misconvergence of this sort using conventional techniques, and the reason why will be described hereinbelow.

One approach of correcting the misconvergence pattern of FIG. 3 is the method described in the patent application 56-91275 "PICTURE CORRECTING APPARATUS OF IN-LINE TYPE COLOR PICTURE TUBE" previously field by the present applicant. The point of this method of correction is that the acting range of the control magnetic field acting on the coil bodies $\mathbf{9}_{11}$ to $\mathbf{9}_{22}$ is set to C in a graph of FIG. 11 showing the relationship between magnetic field and inductance, with the amount of the d.c. magnetic bias being made small from A to B. To obtain such an acting range C, it is necessary not only to reduce the amount of d.c. magnetic bias but also narrow the diameter of the spool type cores $\mathbf{10}_{11}$ to $\mathbf{10}_{22}$, and therefore, productivity lowers in the manufacturing process of the spool type cores or the spool type cores are apt to be broken during winding operation and these phenomena are problems on mass-production.

The S-shaped misconvergence shown in FIG. 4 is a phenomenon which occurs when the number of turns of the coils $\mathbf{11}_{11}$ to $\mathbf{11}_{22}$ is increased so as to increase the inductance variation of the saturable reactors SR1*b*, SR2*b*, and this is caused from the increase in ampere-turns of the horizontal deflecting current flowing through the coils $\mathbf{11}_{11}$, $\mathbf{11}_{22}$ and the number of turns of the coils $\mathbf{11}_{11}$ to $\mathbf{11}_{22}$. This point will be described in detail hereinlater.

At the present time, since the above-mentioned S-shaped misconvergence and the misconvergence shown in FIG. 3 cannot be completely removed, deflection yokes for color picture tubes are manufactured by finding a compromisable condition in which the error in convergence is scattered throughout the entire picture so that error appears as an average value at any points. Although it is ideal that an error in misconvergence is equal to or less than 0.2 mm in a super highly precise or highly precise picture tubes whose dot pitch is 0.21 to 0.33 mm, skilled workers are needed to achieve adjustment for reducing the error in misconvergence to such an extent, while it takes a long period of time and the result of adjustment are not necessarily satisfactory. Namely, there has been a drawback that it is impossible to mass produce low-cost deflection yokes having a misconvergence level that is required by the market.

SUMMARY OF THE INVENTION

The present invention has been developed in order to remove the above-described drawbacks inherent to the conventional picture correcting apparatus for use with an in-line type picture tube.

It is, therefore, an object of the present invention to provide a new and useful picture correcting apparatus for use with an in-line type picture tube, with which various patterns of misconvergence can be readily corrected without requiring complex circuit arrangements.

According to a feature of the present invention the intensity of a magnetic field, which causes the change in impedance of coils of saturable reactors respectively connected in series with two horizontal deflecting coils, is increased so that the variation rate of the inductance expressed in terms of a differential coefficient has the relationship of $\theta e/\theta m \leqq 0.5$ wherein $\theta m$ is a differential coefficient around the center of the picture where the degree of vertical deflection is very small and $\theta e$ is a differential coefficient at top and bottom sides of the picture where the degree of vertical deflection is maximum.

In accordance with the present invention there is provided a picture correcting apparatus for use with an in-line type color picture tube of a self-convergence system, comprising: first and second horizontal deflecting coils; first and second vertical deflecting coils; a first saturable reactor having a first coil, a first core provided for the first coil, and at least one permanent magnet for magnetizing the first core in a given direction, the first coil being connected in series to the first horizontal deflecting coil so as to form a first series circuit; a second saturable reactor having a third coil, a third core provided for the third coil, and at least one permanent magnet for magnetizing the third core in a given direction, the third coil being connected in series to the second horizontal deflecting coil so as to form a second series circuit; the first and second series circuits being connected in parallel such that a parallel circuit of the first and second series circuits receives a horizontal deflection driving current; the first and second saturable reactors being positioned diametrically with respect to a neck portion of the picture tube so as to receive leakage flux from the first and second vertical deflecting coils; the winding directions of the first and second coils and the polarity of the magnets of the first and second saturable reactors being selected such that the impedance of the first coil increases and decreases when the impedance of the second coil respectively decreases and increases in accordance with a degree of vertical deflection effected by the vertical deflecting coils; and means for causing a ratio $\theta e/\theta m$ to assume a value equal to or smaller than 0.5 so that increasing rate of the amount of correction of the convergence of horizontal lines decreases as the degree of vertical deflection is increased where $\theta m$ is a differential coefficient around the center of the picture where the degree of vertical deflection is very small and $\theta e$ is a differential coefficient at top and bottom sides of the picture where the degree of vertical deflection is maximum, each of the differential coefficients corresponding to changing rate of the inductance of the first and second coils of the saturable reactors.

In accordance with the present invention there is also provided a picture correcting apparatus for use with an in-line type color picture tube of a self-convergence system, comprising: first and second horizontal deflecting coils; first and second vertical deflecting coils; a first saturable reactor having first and second coils connected in series in opposite directions, first and second cores respectively provided for the first and second coils, and at least one permanent magnet for magnetizing the first and second cores in a given direction, a series circuit of the first and second coils being connected in series to the first horizontal deflecting coil so as to form a first series circuit; a second saturable reactor having third and fourth coils connected in series in opposite directions, third and fourth cores respectively provided for the third and fourth coils, and at least one permanent magnet for magnetizing the third and fourth cores in a given direction, a series circuit of the third and fourth coils being connected in series to the second horizontal deflecting coil so as to form a second series circuit; the first and second series circuits being connected in parallel such that a parallel circuit of the first and second series circuits receives a horizontal deflection driving current; the first and second saturable reactors being positioned diametrically with respect to a neck portion of the picture tube so as to receive leakage flux from the first and second vertical deflecting coils; the winding directions of the first through fourth coils and the polarity of the magnets of the first and second saturable reactors being selected such that the impedance of the series circuits of the first and second coils increases and decreases when the impedance of the series circuit of the third and fourth coils respectively decreases and increases in accordance with a degree of vertical deflection effected by the vertical deflecting coils; and means for causing a ratio $\theta e/\theta m$ to assume a value equal to or smaller than 0.5 so that increasing rate of the amount of correction of the convergence of horizontal lines decreases as the degree of vertical deflection is increased where $\theta m$ is a differential coefficient around the center of the picture where the degree of vertical deflection is very small and $\theta e$ is a differential coefficient at top and bottom sides of the picture where the degree of vertical deflection is maximum, each of the differential coefficients corresponding to changing rate of the inductance of the first through fourth coils of the saturable reactors.

The value of $\theta/\theta m$ is set to be equal to or less than 0.5, and may assume a negative value whose smallest limit is $-1$ as will be described hereinafter. This means that the magnetic field applied to the saturable reactors may be increased to an extent that the slope of inductance curve of the saturable reactors represented by $\theta e$ has a polarity different from that of the slope represented by $\theta m$.

In one embodiment, an auxiliary coil is employed in each saturable reactor so as to produce a magnetic field which varies with the vertical deflection period. In another embodiment, one or more magnetic members are attached to the cores of the saturable reactors so as to reduce reluctance of the magnetic circuit thereof. With such arrangement of the present invention, the magnitude of the magnetic field applied to the saturable reactors has been increased compared to conventional arrangement, and therefore, the increasing rate of the amount of correction of convergence of horizontal lines on the screen decreases as the magnitude of the vertical deflection increases toward the top and bottom of the screen.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 11:
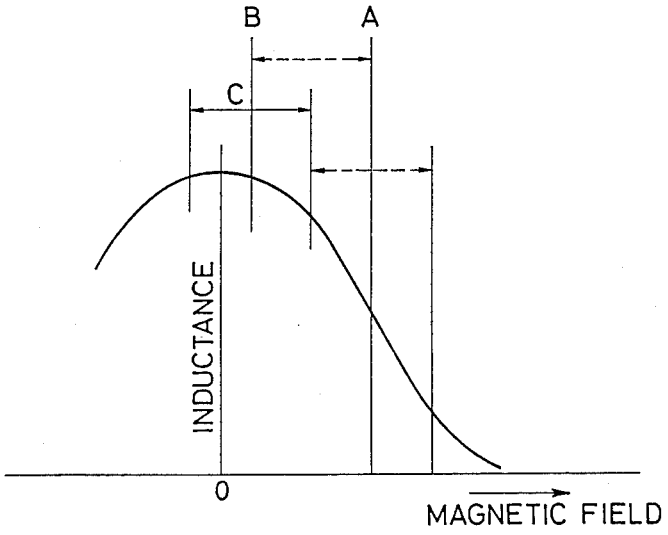
FIG. 11 PRIOR ART
FIG. 11 is a diagram for the description of the conventional way of correction of misconvergence.

Embodiments of the present invention will be described with reference to drawings following FIG. 11. In the embodiments, the picture correcting apparatus has a structure such that it is built in a portion of a deflection yoke of a color picture tube. More specifically, the picture or raster correcting apparatus is a part of a deflection yoke attached to a neck of a color picture tube of in line type to which self-convergence system is applied. Self-convergence system is a system in which dynamic convergence of three electron beams from three electron guns arranged in line is automatically performed by way of the horizontal and vertical deflecting magnetic fields by making a pincushion-shaped horizontal deflecting magnetic field and a barrel-shaped vertical deflection magnetic field.

Figure 12:
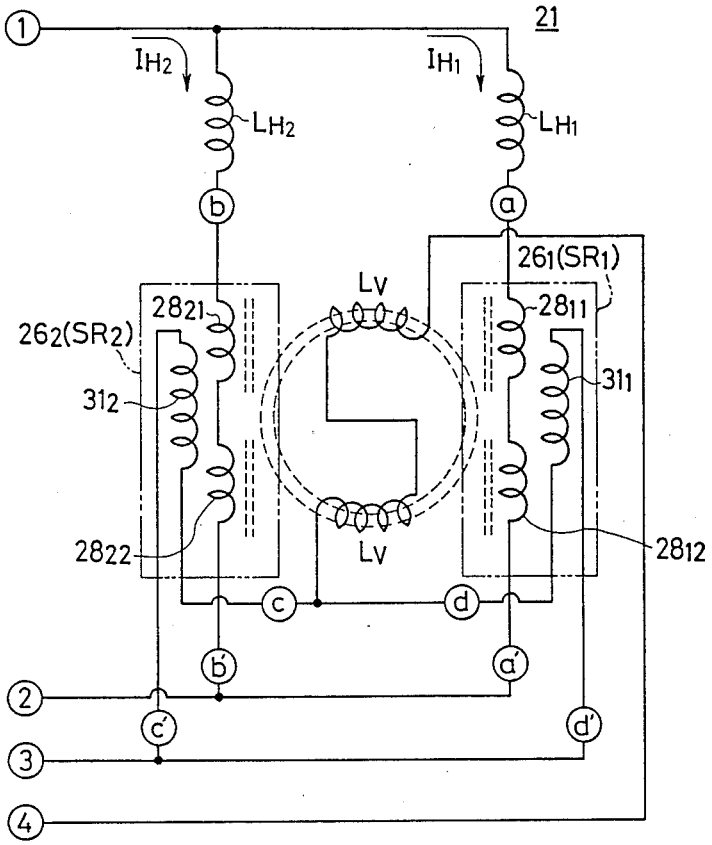
FIG. 12 is circuit diagram of an embodiment of picture correcting apparatus according to the present invention.
Figure 13:
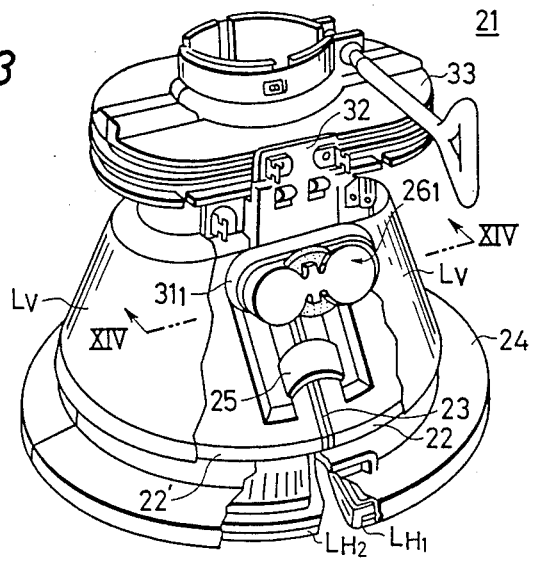
FIG. 13 is a perspective view of a deflection yoke which is present invention apparatus.
Figure 14:
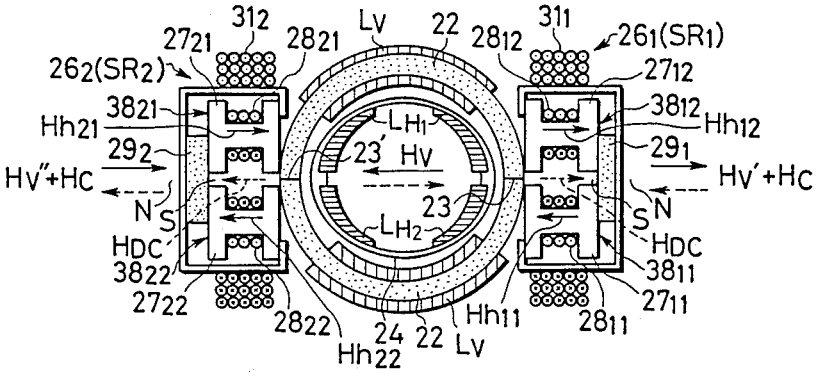
FIG. 14 is a cross-sectional view taken along a horizontal plane including a line XIV—XIV in FIG. 13.

Referring now to FIG. 12 a circuit diagram of an embodiment of the present invention is shown. FIGS. 13 and 14 show mechanical structures of the picture correcting apparatus of FIG. 12 respectively. In these diagrams, the references $L_{H1}$, $L_{H2}$ are a pair of saddle shaped horizontal deflecting coils; the reference $L_V$ being a toroidal vertical deflecting coil and these members form a deflection yoke 21. The vertical deflecting coil LV actually comprises a pair of coils connected in series and this pair of coils is simply referred to as a vertical deflecting coil LV in the following description.

A pair of cores 22, 22', around which the vertical deflecting coil $L_V$ is wound, face each other and are secured by a clamper 25 under the condition that the cores 22, 22' are placed on a separator 24 made of an insulating material, in which the horizontal deflecting coils $L_{H1}$, $L_{H2}$ are built. Furthermore, a pair of saturable reactors $26_1$, $26_2$ (SR1, SR2), which constitute a main part of the present invention, are attached in the vicinity of a facing portion 23.

Figure 15:
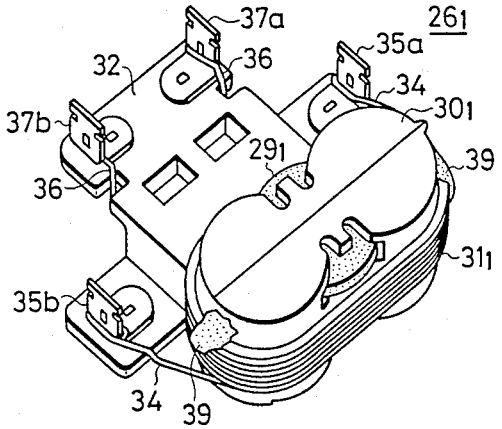
FIG. 15 is a diagram showing the saturable reactor of FIG. 13 with the same being taken out therefrom.
Figure 16:
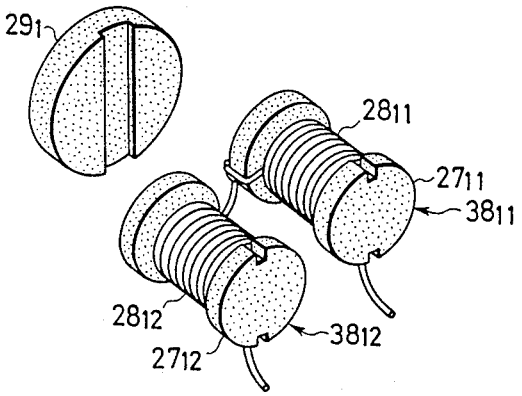
FIG. 16 is a perspective view showing a controlled coil and a permanent magnet both built in the reactor of FIG. 15.
Figure 17:
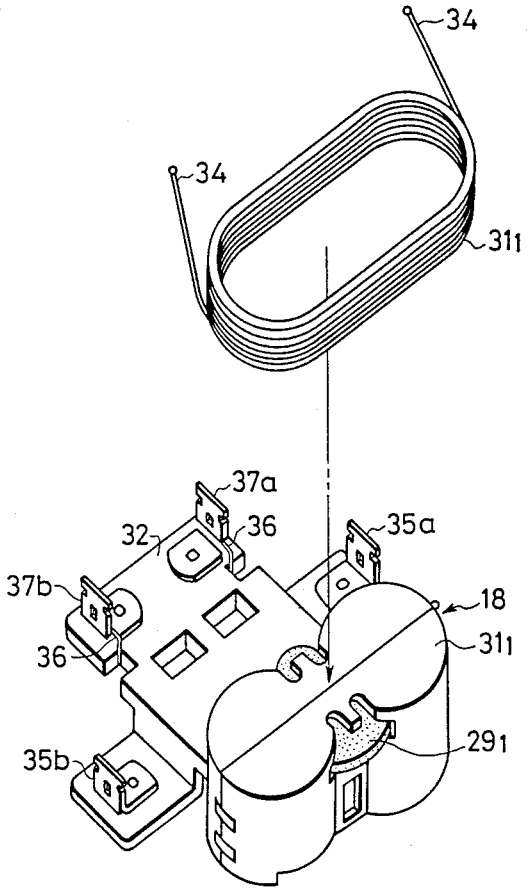
FIG. 17 is a perspective view showing an auxiliary control coil which is separate from the saturable reactor of FIG. 15.

FIG. 15 shows this saturable reactor $26_1$ as it has been taken out. The saturable reactor $26_1$ has a structure such that coil bodies $38_{11}$, $38_{22}$ with controlled coils $28_{11}$, $28_{22}$ made of conductive wires wound around spool type cores $27_{11}$, $27_{12}$ shown in FIG. 16 and a single permanent magnet $29_1$ for giving d.c. magnetic bias are built in a casing $30_1$ made of a synthetic resin with the positional relationship shown in the diagram, while an auxiliary control coil 311, which forms a main part of the present invention, is telescopically applied to the outer periphery of the casing $30_1$ to be secured thereto as shown in FIG. 17. The saturable reactor $26_1$ is attached such that a terminal board 32, which is integral with the casing $31_1$, is secured to a cylindrical flange portion 33 of the separate 24.

The auxiliary control coil $31_1$ has a structure such that a wire having heat-fusable layer on the surface of an insulating film is wound by a given number of turns in an ellipse in a manner of multi-layer solenoid and is hardened as shown in FIG. 17. The auxiliary control coil $31_1$ is telescopically coupled with the periphery of the casing 30 and is secured thereto by means of an adhesive 31. Lead wires 34 at both ends of the auxiliary control coil $31_1$ are connected to terminals 35a, 35b of the terminal board 32 as shown in FIG. 15, while lead wires 36 at both ends of the controlled coils $28_{11}$, $28_{12}$ are connected to terminals 37*a*, 37*b*.

The other saturable reactor $26_2$ has the same structure as the above-mentioned saturable reactor $26_1$ such that it has coil assemblies $38_{21}$, $38_{22}$ having controlled coils $28_{21}$, $28_{22}$ formed on spool type cores $27_{21}$, $27_{22}$, a permanent magnet $29_2$ for giving d.c. magnetic bias, and an auxiliary control coil $31_2$.

The controlled coils $28_{11}$ and $28_{22}$ as well as $28_{21}$ and $28_{22}$ are connected to each other so that their winding directions are opposite to each other.

As shown in FIG. 12, the auxiliary control coils $31_1$ ⓒ ~ ⓒ', 312 ⓓ ~ ⓓ' are connected in parallel, and this parallel circuit is connected in series with the vertical deflecting coil $L_V$. The winding direction of the auxiliary control coils $31_1$, $31_2$ is determined so that an auxiliary magnetic field Hc of the same polarity as that of the magnetic fields Hv', Hv'' emitted outside form the cores 4 and 4' is generated. The controlled coils $28_{11}$, $28_{22}$ are connected in series to one horizontal deflecting coil $L_{H1}$, while controlled coils $28_{21}$, $28_{22}$ are connected to the other horizontal deflecting coil $L_{H2}$ in series. With this arrangement, the controlled coils $28_{11}$ and $28_{12}$ which are connected in series are connected in series with the first horizontal deflecting coil $L_{H1}$ so as to form a first series circuit, while the controlled coils $28_{21}$ and $28_{22}$ which are connected in series are also connected in series with the second horizontal deflecting coil LH2 so as to form a second series circuit. These two series circuits are connected in parallel between terminals 1 and 2 to receive a horizontal deflection driving current applied from an unshown known deflection driving circuit.

The permanent magnets $29_1$, $29_2$ are circular plates having a radial wide U-shaped groove, and are attached so as to be manually rotatable to adjust d.c. magnetic bias with the rotation of the same.

In addition to the magnetic field Hv' emitted outside the cores 4 and 4' with the vertical deflecting period and the d.c. bias magnetic field $H_{DC}$ from the permanent magnet $29_1$, an auxiliary magnetic field Hc by vertical deflecting current flowing through the auxiliary control coil 311 acts on the saturable reactor $26_1$ of the above-described structure as shown in FIG. 14 so that the inductance between both terminals of the controlled coils $28_{11}$, $28_{12}$, i.e. terminals ⓐ ~ ⓐ' (37*a*, 37*b*) is varied in accordance with the change in the control magnetic fields Hv' Hc. Similarly, the inductance between both terminals ⓑ ~ ⓑ' of the controlled coils $28_{21}$, $28_{22}$ of the other saturable reactor $26_1$ is varied in accordance with the magnetic field Hv'' emitted outside the cores 4 and 4'+ the auxiliary magnetic field Hc from the auxiliary control coil $31_2$.

As described in the above, the present invention apparatus is arranged such that error in misconvergence is corrected by changing impedance of circuits including horizontal deflecting coils $L_{H1}$, $L_{H2}$ and the controlled coils of the saturable reactors SR1 and SR2, by way of control magnetic fields Hv'+Hc, Hv''+Hc which varies with a vertical deflecting period, and by way of a magnetic field Hh which is generated by the horizontal deflecting current flowing through the controlled coils $28_{11}$ to $28_{22}$ per se.

The saturable reactors SR1, SR2 of the above-mentioned deflection yoke 21 have a basic structure that auxiliary control coils $31_1$, $31_2$ are added to saturable reactors SR1*b*, SR2*b* used in conventional deflecting apparatus, and therefore, the following description will be made under an assumption that the auxiliary control coils $31_1$, $31_2$ are added to saturable reactors SR1*b*, SR2*b* used in conventional apparatus.

Figure 18:
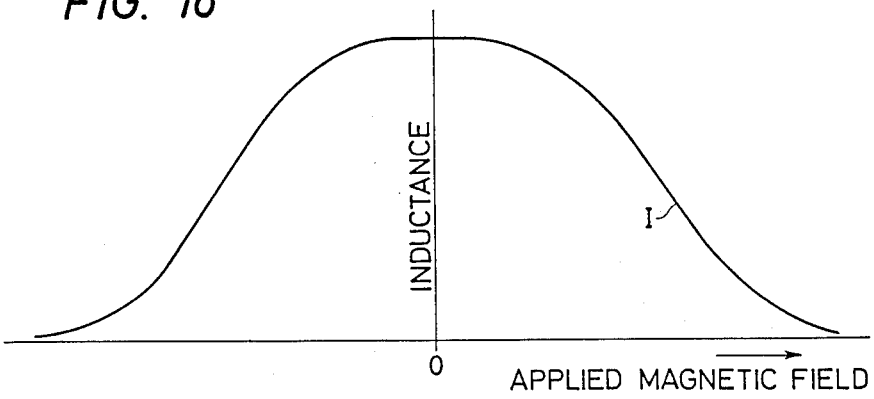
FIG. 18 is a diagram showing a curve of the change in inductance.

Since saturation characteristic of the inductance of a coil wound around a ferrite core changes generally as shown by a curve I in FIG. 18, the value of inductances L11, L12, L21, L22 of the respective voils 2811, 2812 and coils 2821, 2822 as well as the value of inductances LSR1, LSR2 of the saturable reactors SR1, SR2 are given by the following equations with the values being approximated and normalized:

$$L_{11}=(\tfrac{1}{2})\ tanh\{(\pi/2)\ sinh(H+1.5)\}+(\tfrac{1}{2}) \quad (1)$$

$$L_{12}=(\tfrac{1}{2})\ tanh\{(\pi/2)\ sinh(-H+1.5)\}+(\tfrac{1}{2}) \quad (2)$$

$$L_{21}=(\tfrac{1}{2})\ tanh\{(\pi/2)\ sinh(H+1.5)\}+(\tfrac{1}{2}) \quad (3)$$

$$L_{22}=(\tfrac{1}{2})\ tanh\{(\pi/2)\ sinh(-H+1.5)\}+(\tfrac{1}{2}) \quad (4)$$

$$L_{SR1}=L_{11}+L_{12} \quad (5)$$

$$L_{SR2}=L_{21}+L_{22} \quad (6)$$

Here;

$$H=H_{DC}+Hcv+Hh \quad (7)$$

$$Hcv=Hc+Hv' \text{ or } Hcv=Hc+Hv'' \quad (8)$$

In Eqs. (7) and (8);

$H_{DC}$ is a d.c. bias magnetic field;

Hcv is the control magnetic field of vertical deflecting period ($Hc+Hv'$ or $Hc+Hv''$)

Hh is a magnetic field by the horizontal deflecting current flowing through the control coils.

Figure 19:
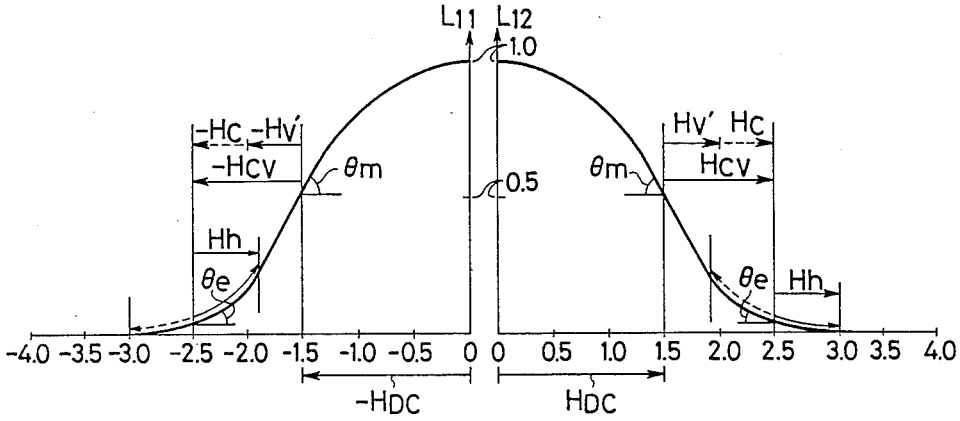
FIGS. 19 and 20 are inductance change curves approximated by hyperbolic functions.
Figure 20:
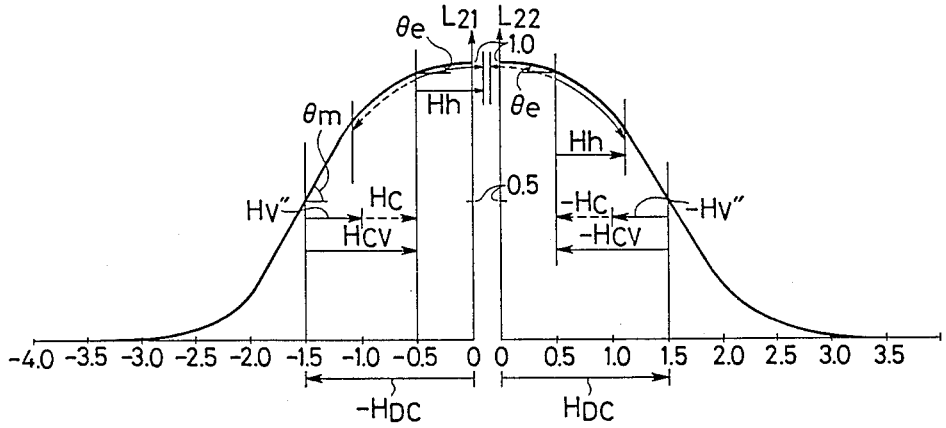
Figure 21A:
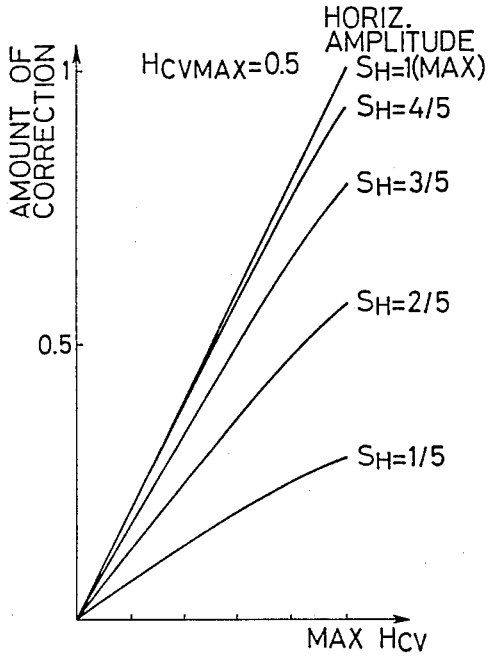
FIGS. 21A to 21D and 22A to 22D are graphs showing the amount of correction of convergence.
Figure 21B:
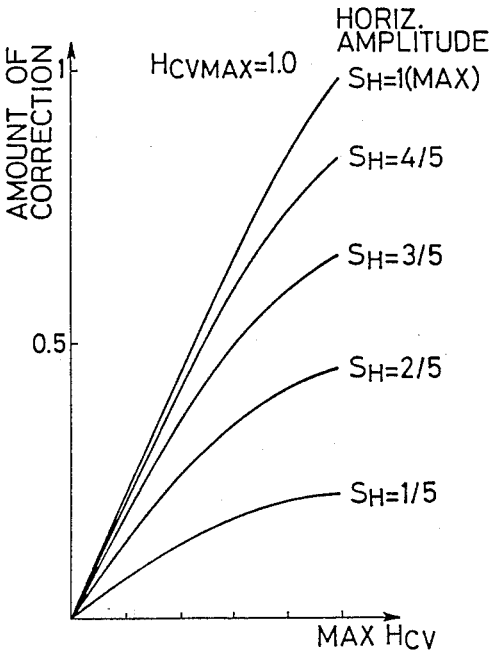
Figure 21C:
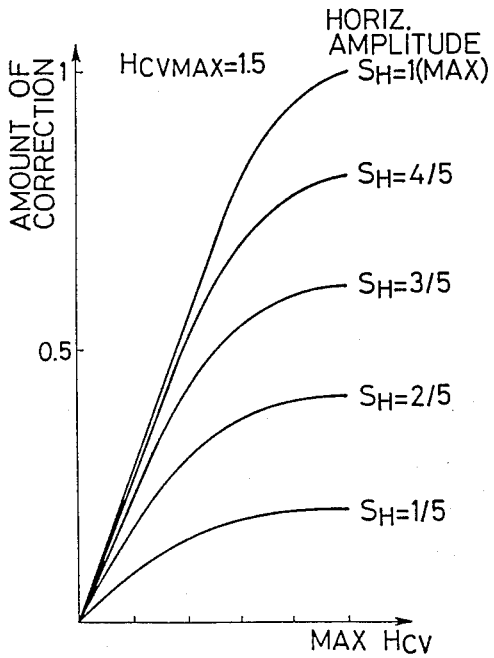
Figure 21D:
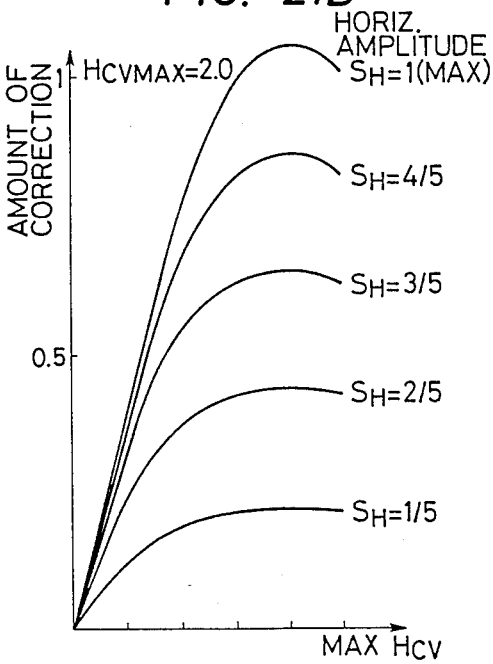
Figure 22A:
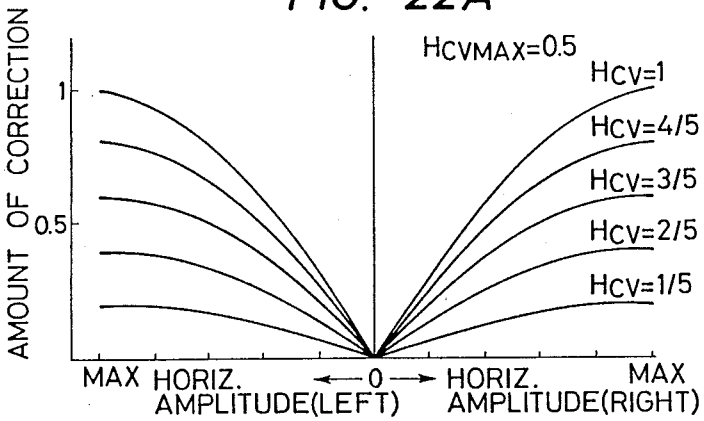
Figure 22B:
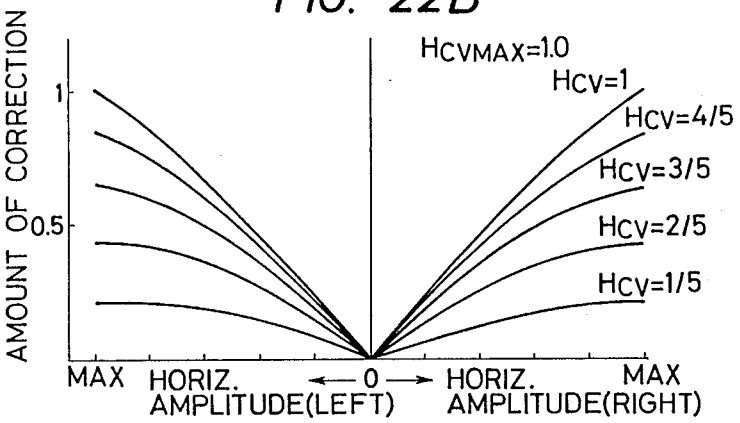
Figure 22C:
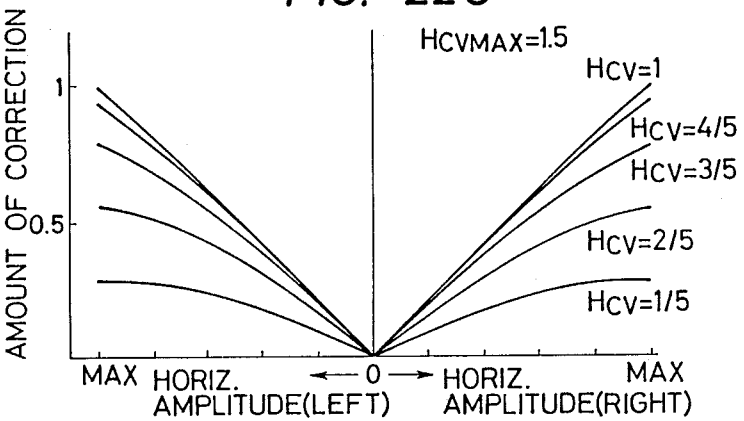
Figure 22D:
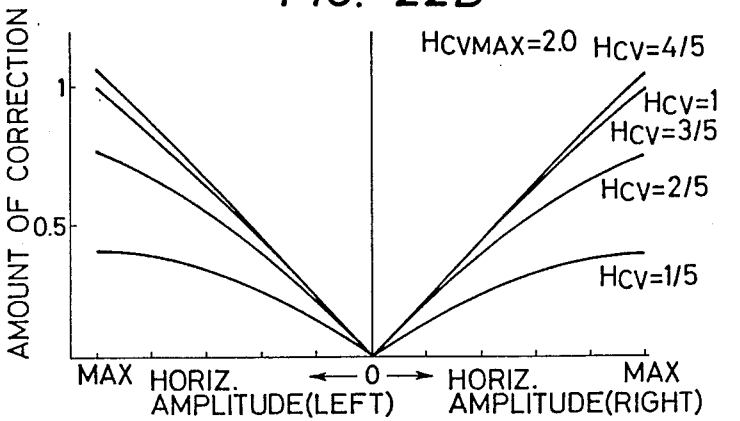

In FIGS. 19 and 20, the variation of the magnetic field Hh in the direction of the solid line in the diagram indicates that deflection is made toward the right of the screen, while the variation toward the broken line indicates that deflection is made toward the right of the screen, while the variation toward the broken line indicates that deflection is made toward the left of the screen. As will be understood from this, the inductances of the saturable reactors SR1, SR2 change in opposite directions in accordance with the variation in the horizontal deflecting current. This is described in detail in a patent application No. 57-221598 (published June 27, 1984, with provisional publication No. 59-111481) titled "PICTURE CORRECTING APPARATUS FOR IN-LINE TYPE COLOR PICTURE TUBE".

Figure 1:
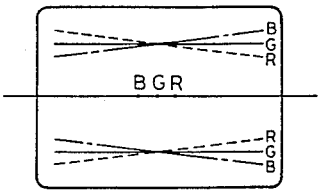
FIGS. 1 to 4 are diagrams showing different misconvergence patterns.
Figure 2:
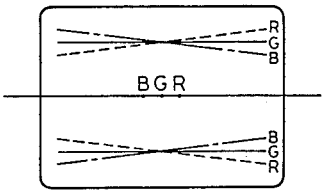

Since the amount of convergence correction is substantially proportional to the inductance of the saturable reactors SR1, SR2 and horizontal deflecting distance along the screen (see FIGS. 1 to 3) the amount of correction Δ (x, y) of convergence is given by the following equation when the center of the screen is used as an origin of coordinate and the horizontal direction and vertical direction are respectively set to x-distance and y-distance:

$$\Delta(x, y) = |L_{SR1}(x, y) - L_{SR2}(x, y)| \times |(Ihx/Ihp)| \quad (9)$$

wherein Ihp is the maximum horizontal deflecting current (in the case of deflection to the end of the screen);

Ihx is the horizontal deflecting current necessary for deflecting to x co-ordinate;

$L_{SR1}$ (x, y) is the value of inductance of the saturable reactor SR1 caused from the magnetic field Hh by the horizontal deflecting current and from the control magnetic field Hcv by the vertical deflecting current necessary for deflecting to a co-ordinate (x, y);

$L_{SR2}$ (x, y) is the value of inductance of the saturable reactor SR2 caused from the magnetic field Hh by the horizontal deflecting current and from the control magnetic field Hcv by the vertical deflecting current necessary for deflecting to a co-ordinate (x, y).

FIGS. 21A to 21D are diagrams drawn with the amount of correction on remaining portions on the screen being calculated using these equations where 0.55 is substituted for Hhmax as a substitute of ampere-turns of the controlled coil, which value is necessary for calculation, and the amount of correction in the case that vertical and horizontal deflections are maximum (i.e. at four corners of the screen) is set to 1.

It will be understood from these diagrams that as the magnitude of the control magnetic field becomes larger and larger, namely as the vertical deflection is strongly made, the increasing rate of the amount of convergence correction becomes smaller and smaller. The horizontal amplitude SH in the diagram is in proportion to the magnetic field intensity Hh. Therefore, misconvergence of FIG. 3 having a pattern that the error becomes smaller and smaller as approaching the top and bottom from the center of the screen in the vertical direction, i.e. as the magnitude of vertical deflection becomes larger, can be corrected.

The reason why such correction is possible is that the inductances $L_{11}$ to $L_{22}$, $L_{SR1}$, $L_{SR2}$ are functions of the magnetic field Hh as will be understood from Eqs. (1) to (9), and basically, that there is a difference in differential coefficient of the varying curve of the inductance between the beginning or ending of vertical deflection, i.e. top and bottom of the screen, and a place around the center of the screen where the vertical deflection is very small.

Using θe for the differential coefficient of the variation of the inductance corresponding to the top and bottom of the screen, and using θm for the differential coefficient around the center of the screen (see FIGS. 19 and 20), when the control magnetic field Hcv is changed, then θe/θm varies. It has been confirmed as a result of experiments with the control magnetic field Hcv being changed to various values for correcting misconvergence, that desired correction is resulted when θe/θm is equal to or smaller than 0.5. Since the intensity of the magnetic field applied to the controlled coil of each of the saturable reactors SR1 and SR2 can be increased to an extent that the polarity of θe may be different from that of θm, θe/θm may assume a negative value. Since the maximum absolute value of θe equals the absolute value of θm, θe/θm assumes −1 at the smallest.

Figure 4:
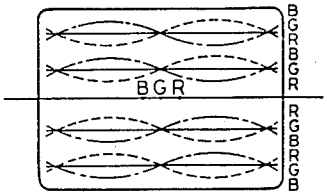

The amounts of corrections at respective portions on the S-shaped misconvergence screen of FIG. 4 are calculated using the above Eqs. (1) to (9), and are shown in FIGS. 22A to 22D. From these diagrams, it will be understood that the amount of correction increases along the increase in the horizontal amplitude SH as the control magnetic field Hcv max becomes larger and larger. Namely, it will be understood that the misconvergence shown in FIG. 4 can be corrected by the present invention apparatus.

This correction is basically a function of Hh/Hcv, and when Hh/Hcv is made small, the effect of correction is exhibited. However, in order to correct the pattern shown in FIG. 3, since it is impossible to drastically change the value of Hh, it is necessary to make the value of Hcv large to reduce Hh/Hcv.

Figure 3:
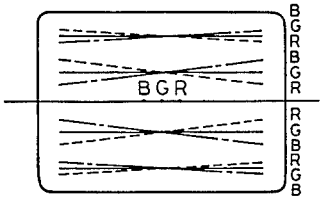

When both Hh/Hcv and θe/θm are made small, it is now possible to correct misconvergence corresponding to a combination of the misconvergences of FIGS. 3 and 4.

Figure 23:
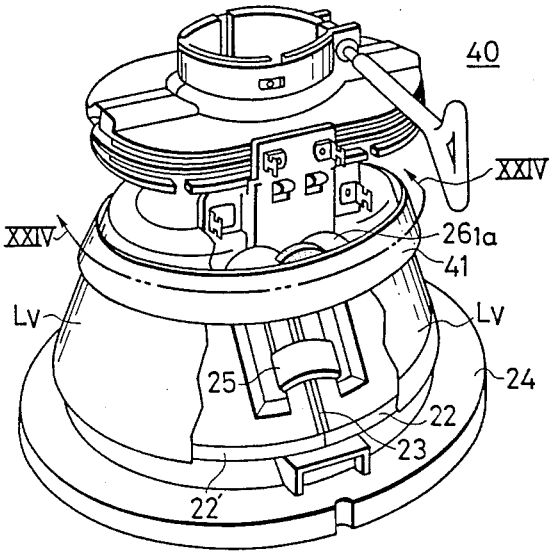
FIG. 23 is a perspective view of another embodiment of the present invention apparatus.
Figure 24:
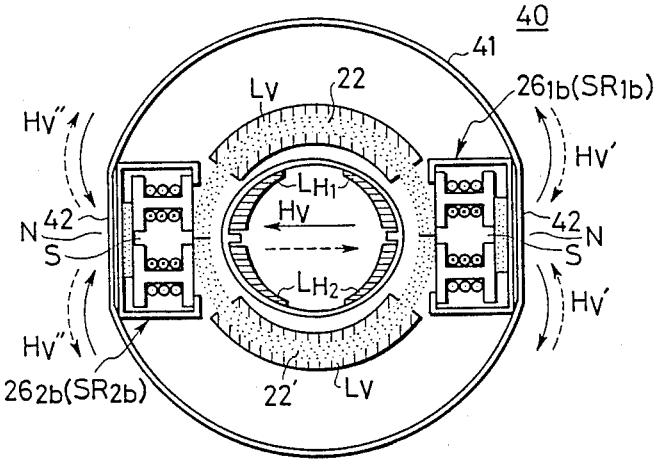
FIG. 24 is a cross-sectional view taken along a plane including line XXIV—XXIV in FIG. 23.

FIGS. 23 and 24 show another embodiment of the picture correcting apparatus according to the present invention. In these diagrams, constructional parts which are the same as those in FIGS. 13 and 14 are designated at like references, and their description is omitted.

A deflection yoke 40 has a structure such that an ellipse ring or belt 41 made of a magnetic substance, which surrounds the deflection yoke 40, is secured by way of an adhesive so as to be in contact with the casings $30_1$, $30_2$, while the above-mentioned auxiliary control coil 31 is removed. More specifically, the ring 41 is located so as to be close to an outer surface of the disk-like permanent magnets 42 of the saturable reactors SR1*b* and SR2*b*. According to the deflection yoke 40 having such structure, the reluctance of the magnetic circuit including the saturable reactors $26_{1b}$, $26_{2b}$ is reduced so that the ring 41 picks up magnetic fields Hv', Hv'' of vertical deflection period which is emitted outside the core 41. With this operation, the magnetic fields Hv', Hv'' passing through the spool type cores $27_{11}$, $27_{12}$ of the saturable reactors SR1*b*, SR2*b* are increased so as to obtain the same results as the above-mentioned deflection yoke 40.

Figure 25:
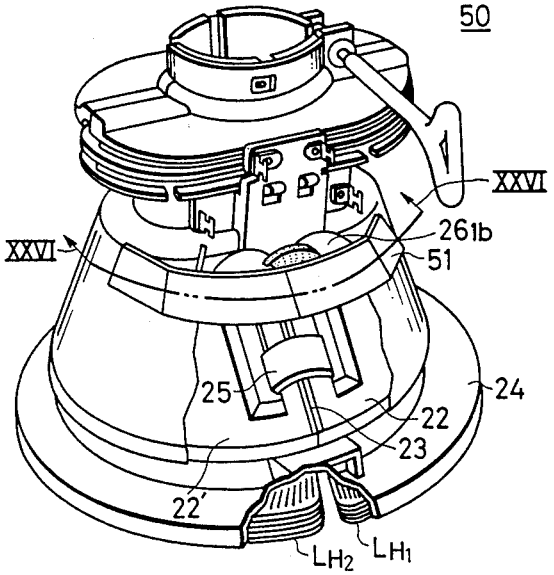
FIG. 25 is a perspective view of a further embodiment of the present invention apparatus.
Figure 26:
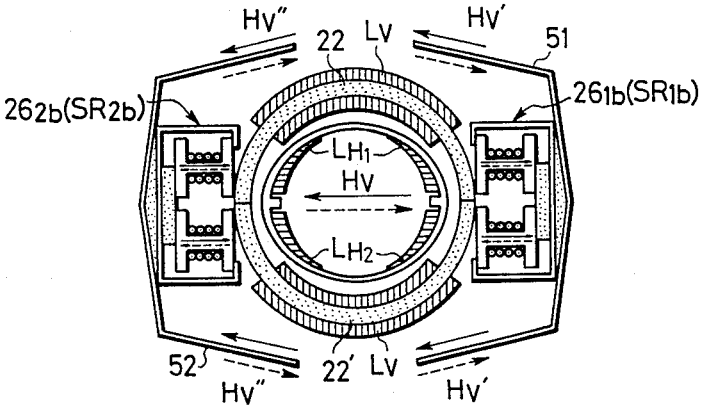
FIG. 26 is a cross-sectional view taken along a plane including line XXVI—XXVI in FIG. 25.

FIGS. 25 and 26 show a further embodiment of the present invention apparatus. In these diagrams, constructional parts which are the same as those in FIGS. 21 and 22 are designated at like references, and their description is omitted.

A deflection yoke 50 has a structure such that U-shaped wing members 51, 52 made of a magnetic substance are adhered and secured to the casings $30_1$, $30_2$ in place of the ring 41. The wing members 51, 52 operate similarly to the above-mentioned ring 41 so that the magnetic fields Hv', Hv'' passing through the spool type cores $27_{11}$, $27_{12}$ of the saturable reactors $26_{1b}$, $26_{2b}$ (SR1*b*, SR2*b*) are increased. The deflection yoke 50 also functions in the same manner as the above-mentioned deflection yoke 40.

The above-mentioned ring 41 and wing members 51, 52, which are made of a magnetic substance, have a function, in addition to a function of increasing the above-mentioned control magnetic field, of weakening leakage flux emitted from the deflection yoke to the periphery thereof, and it also operates as a shielding which reduces the influence by metallic plates around the picture tube to the deflection magnetic field. As a result, the freedom in designing of a television set can be remarkably improved.

Figure 5:
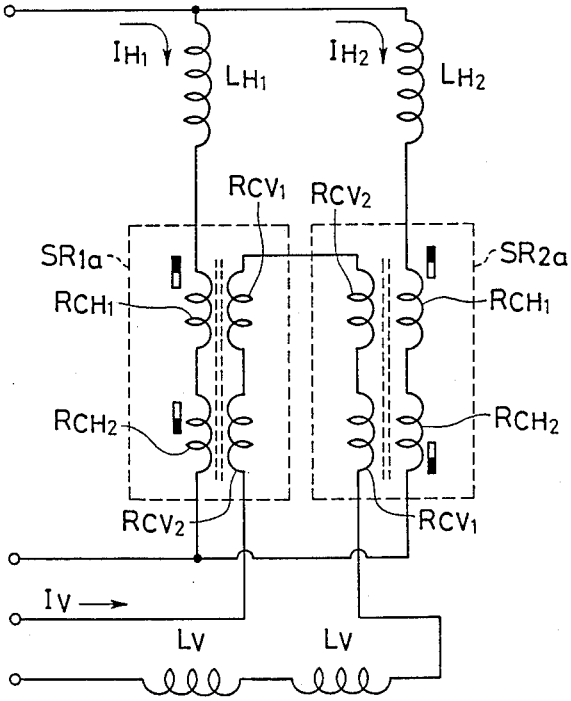
FIG. 5 PRIOR ART
FIGS. 5 and 6 are wiring diagrams showing respectively examples of deflection yokes which are conventional picture correcting apparatus.
Figure 6:
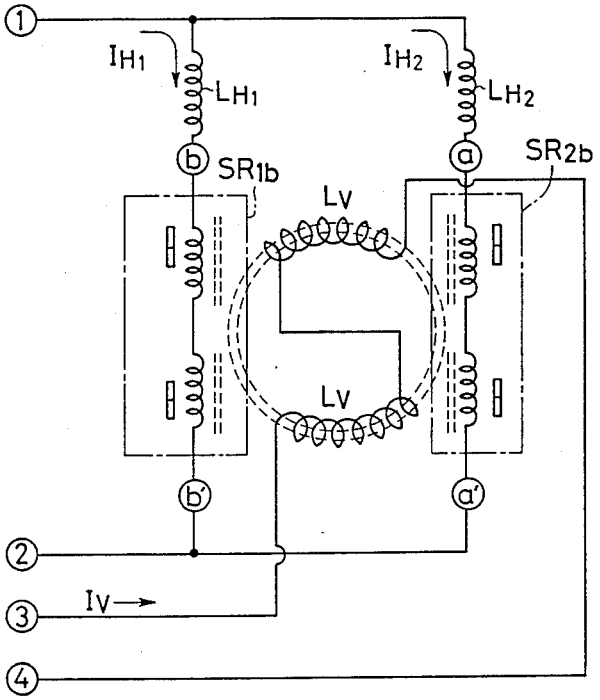
FIG. 6 PRIOR ART
Figure 7:
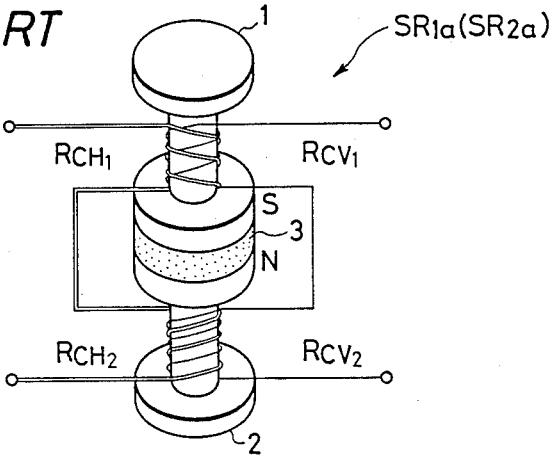
FIG. 7 PRIOR ART
FIG. 7 is a diagram showing the structure of a reactor applied to FIG. 5.
Figure 8:
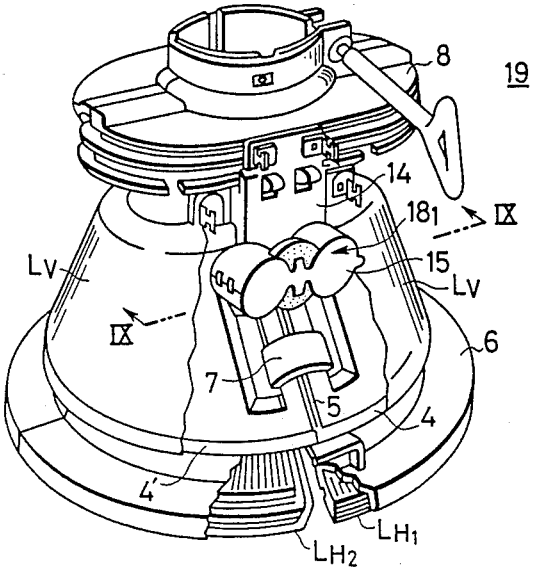
FIG. 8 PRIOR ART
FIG. 8 is a diagram showing a deflection yoke of FIG. 6.
Figure 9:
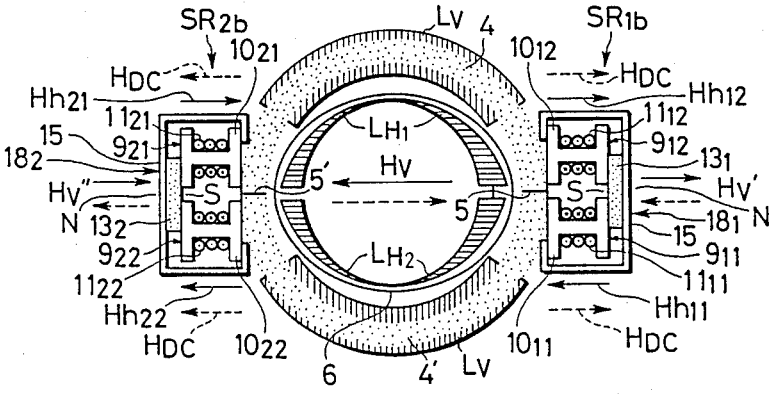
FIG. 9 PRIOR ART
FIG. 9 is a cross-sectional view taken along a horizontal plane including a line IX—IX in FIG. 8.
Figure 10:
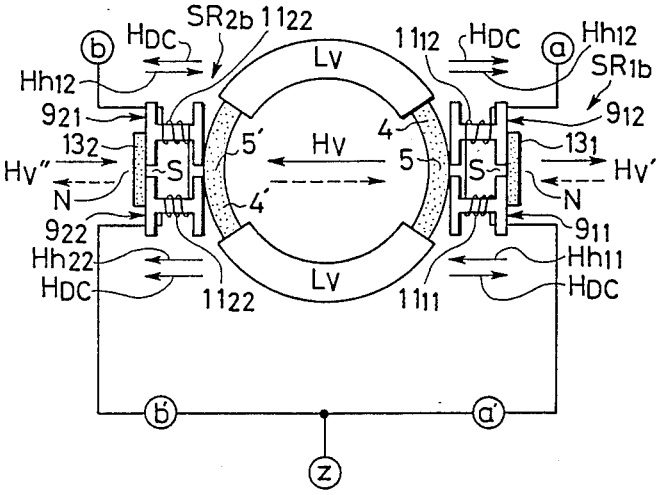
FIG. 10 PRIOR ART
FIG. 10 is a wiring diagram of the reactor of FIGS. 8 and 9.

Even in the correcting apparatus having a circuit shown in FIG. 5, if the number of turns of the control coils Rcv1, Rcv2 is increased, the magnitude of the control magnetic field Hcv is made large providing the same effect as the above-mentioned deflection yoke 40.

Furthermore, although the magnitude of the control magnetic field has been increased in the above-described respective embodiments for setting $\theta e/\theta m$ to a value equal to or smaller than 0.5, it is also possible to set $\theta e/\theta m$ to a value equal to or smaller than 0.5 by suitably selecting the substance of the spool type cores such that the substance is of high maximum magnetic flux density Bm and low residual flux density Br like Mn Zn. However, this way of achieving a small value of $\theta e/\theta m$ by selecting only the substance of the spool type cores is not practical because temperature characteristic of such a saturable reactor is unstable. For this reason, it is necessary to use one of the above-mentioned auxiliary coils 311 and 312, ring 41 or the U-shaped wings 51 and 52 to obtain a desired value of $\theta e/\theta m$.

As described in the above, since the apparatus for correcting picture of in-line type color picture tube according to the present invention has a structure such that a control magnetic field by way of a sawtooth wave current of vertical deflecting period, for saturable reactors used in apparatus for error in convergence of horizontal lines by changing the distribution of the magnetic field of the horizontal magnetic field with horizotal deflecting currents flowing through a pair of horizontal deflecting coils being differentially changed at vertical deflecting period by way of horizontal deflecting current flowing through controlled coils of the saturable reactors, it is now possible to minimize errors in misconvergences shown in FIGS. 3 and 4 which are difficult to correct, without using a dynamic convergence correcting circuit or the like, i.e. with a simple structure, while improvement in picture quality can be actualized together with reduction in manufacturing cost and improvement in manufacturing efficiency, and furthermore, since the increase in the control magnetic field is aimed by providing an auxiliary magnetic field forming coil which adds an auxiliary magnetic field, or by providing a yoke which effectively utilizes magnetic flux emitted outside the core of the deflection yoke, the structure is extremely simple so that the arrangement does not need particular room.

The above-described embodiments are just examples of the present invention, and therefore, it will be apparent for those skilled in the art that many modifications and variations may be made without departing from the scope of the present invention.

What is claimed is:

1. A picture correcting apparatus for use with an in-line type color picture tube of a self-convergence system, comprising:

(a) first and second horizontal deflecting coils;

(b) first and second vertical deflecting coils;

(c) a first saturable reactor having a first coil, a first core provided for said first coil, and at least one permanent magnet for magnetizing said first core in a given direction, said first coil being connected in series to said first horizontal deflecting coil so as to form a first series circuit;

(d) a second saturable reactor having a second coil, a second core provided for said second coil, and at least one permanent magnet for magnetizing said second core in a given direction, said second coil being connected in series to said second horizontal deflecting coil so as to form a second series circuit; said first and second series circuits being connected in parallel such that a parallel circuit of said first and second series circuits receives a horizontal deflection driving current;

said first and second saturable reactors being positioned diametrically with respect to a neck portion of said picture tube so as to receive leakage flux from said first and second vertical deflecting coils;

the winding directions of said first and second coils of said first and second saturable reactors and the polarity of said magnets of said first and second saturable reactors being selected such that the impedance of said first coil increases and decreases when the impedance of said second coil respectively decreases and increases in accordance with a degree of vertical deflection effected by said vertical deflecting coils; and (e) means for causing a ratio $\theta e/\theta m$ to assume a value equal to or smaller than 0.5 so that an increasing rate of the amount of correction of the convergence of horizontal lines decreases as the degree of vertical deflection is increased where $\theta m$ is a differential coefficient around the center of the picture where the degree of vertical deflection is very small and $\theta e$ is a differential coefficient at top and bottom sides of the picture where the degree of vertical deflection is maximum, each of said differential coefficients corresponding to a changing rate of the inductance of said first and second coils of said saturable reactors.

2. Apparatus as claimed in claim 1, wherein said means comprises third and fourth coils respectively wound around said first and second cores of said first and second saturable reactors, said third and fourth coils being connected to said vertical deflecting coils in series to be supplied with a vertical deflection driving current, the winding direction of said third and fourth coils being selected so that a magnetic field of the same direction as that of said leakage flux is produced by said third and fourth coils respectively.

3. Apparatus as claimed in claim 1, wherein said means comprises a magnetic member attached in common to said first and second cores of said first and second saturable reactors so as to reduce the reluctance of the magnetic circuits including the cores of said saturable reactors.

4. Apparatus as claimed in claim 3, wherein said magnetic member is a ring-like metallic band placed close to said permanent magnet of each of said first and second saturable reactors.

5. Apparatus as claimed in claim 1, wherein said means comprises first and second magnetic members attached respectively to said first and second cores of said first and second saturable reactors so as to reduce the reluctance of the magnetic circuits including the cores of said first and second saturable reactors.

6. Apparatus as claimed in claim 5, wherein each of said magnetic members is a U-shaped metallic member placed close to said permanent magnet of each of said first and second saturable reactors.

7. A picture correcting apparatus for use with an in-line type color picture tube of a self-convergence system, comprising:

(a) first and second horizontal deflecting coils;

(b) first and second vertical deflecting coils;

(c) a first saturable reactor having first and second coils connected in series in opposite directions, first and second cores respectively provided for said first and second coils, and at least one permanent magnet for magnetizing said first and second cores in a given direction, a series circuit of said first and second coils being connected in series to said first horizontal deflecting coil so as to form a first series circuit;

(d) a second saturable reactor having third and fourth coils connected in series in opposite directions, third and fourth cores respectively provided for said third and fourth coils, and at least one permanent magnet for magnetizing said third and fourth cores in a given direction, a series circuit of said third and fourth coils being connected in series to said second horizontal deflecting coil so as to form a second series circuit; said first and second series circuits being connected in parallel such that a parallel circuit of said first and second series circuits receives a horizontal deflection driving current;

said first and second saturable reactors being positioned diametrically with respect to a neck portion of said picture tube so as to receive leakage flux from said first and second vertical deflecting coils;

the winding directions of said first through fourth coils and the polarity of said magnets of said first and second saturable reactors being selected such that the impedance of the series circuits of said first and second coils increases and decreases when the impedance of the series circuit of said third and fourth coils respectively decreases and increases in accordance with a degree of vertical deflection effected by said vertical deflecting coils; and (e) means for causing a ratio $\theta e/\theta m$ to assume a value equal to or smaller than 0.5 so that increasing rate of the amount of correction of the convergence of horizontal lines decreases as the degree of vertical deflection is increased where $\theta m$ is a differential coefficient around the center of the picture where the degree of vertical deflection is very small and $\theta e$ is a differential coefficient at top and bottom sides of the picture where the degree of vertical deflection is maximum, each of said differential coefficients corresponding to changing rate of the inductance of said first through fourth coils of said saturable reactors.

* * * * *